US009732571B2

(12) United States Patent
Bjørnenak

(10) Patent No.: US 9,732,571 B2
(45) Date of Patent: Aug. 15, 2017

(54) INJECTOR HEAD CHAIN SYNCHRONIZATION DEVICE

(71) Applicant: Stimline AS, Kristiansand (NO)

(72) Inventor: Mads Bjørnenak, Kristiansand (NO)

(73) Assignee: Stimline AS, Kristiansand (NO)

( * ) Notice: Subject to any disclaimer, the term of this patent is extended or adjusted under 35 U.S.C. 154(b) by 248 days.

(21) Appl. No.: 14/547,757

(22) Filed: Nov. 19, 2014

(65) Prior Publication Data

US 2016/0138347 A1 May 19, 2016

(51) Int. Cl.
*E21B 19/22* (2006.01)
*E21B 19/08* (2006.01)

(52) U.S. Cl.
CPC ..... *E21B 19/22* (2013.01); *E21B 19/08* (2013.01)

(58) Field of Classification Search
CPC ..... E21B 19/08; E21B 19/22
See application file for complete search history.

(56) References Cited

U.S. PATENT DOCUMENTS 5,309,990 A * 5/1994 Lance ..... E21B 19/22 166/384
5,845,708 A * 12/1998 Burge ..... B65H 51/14 166/77.3
6,116,345 A * 9/2000 Fontana ..... B65H 75/22 166/343

* cited by examiner

*Primary Examiner* — Brad Harcourt
(74) *Attorney, Agent, or Firm* — Winstead PC

(57) ABSTRACT

The invention relates to an injector head (2) comprising; a pair of oppositely located, cooperatively movable, segmented continuous belt drive chains (21; 22), said each belt drive chain (21, 22) running over a respective pair of drive sprockets (25*a*, 25*b*) and tension sprockets (26*a*, 26*b*), wherein a tubing receiving section (7') is defined between the belt drive chains (21, 22). The tubing receiving section (7') having a tubing section centerline (46) extending through the center of the tubing receiving section (7'). The injector head (2) having an injector centerline (45) extending through the centerline of the injector head (2), said injector centerline (45) and said tubing section centerline (46) being substantially aligned in the longitudinal direction in an initial position, a pair of elongate counter-force members (32*a*, 32*b*) is positioned at each side of the tubing receiving section (7'). The injector head (2) has at least one actuator (35) adapted to move at least one of said elongate counter-force elongate member (32*a*, 32*b*) in order to bring the tubing section centerline (46) out of alignment with said injector centerline (45).

25 Claims, 12 Drawing Sheets

INJECTOR HEAD CHAIN SYNCHRONIZATION DEVICE

FIELD OF THE INVENTION

The present invention relates to a conveyor apparatus or injector head to enable feeding of continuous elongate device (CED), such as e.g. coiled tubing, rod, wire or wireline down through the conveyor apparatus, to enable insertion of tools through the wellhead and into a well below, or up through the conveyor apparatus by pulling action enabling retrieval of such tools from the wellhead and the well below. In particular the invention relates to an injector head with synchronized belt drive chains.

Such a conveyor apparatus is frequently called an "injector head" in this particular field of use The wellhead is primarily used for oil and natural gas exploration and production operations.

Particularly, the present invention relates to a technology for inserting and retrieval of a drill tool being supported by continuous elongate device (CED) in a non-limiting example being e.g. a continuous tubing, suitably coiled tubing running through the lubricator string sections.

In the description and claims, the general term CED, i.e. Continuous Elongate Device, will be used, implying that the CED may be interpreted as being a continuous tubing (e.g. coiled tubing), continuous rod or interconnected rod sections, continuous wire or continuous wireline. In case of rods or rod sections, this could e.g. be massive rods of metal, metal alloys, carbon material, fiber reinforced plastic material.

The continuous elongate device will hereinafter be referred to as a continuous tubing.

More particularly the present invention relates to an injector head according to the preamble of claim 1.

TECHNICAL BACKGROUND OF THE INVENTION

Use of CED's, such as e.g. coiled tubing, sourced from a hydraulically operated reel is known in oil and natural gas exploration and production operations. These tubings, generally refer to metal pipes, e.g. made from steel, with diameter ranging between 1 inch and 4 inches (2.54-10.12 centimeters), or suitably within the range 1.5 to 3.5 inches (3.81-8.89 centimeters). Such tubing may typically have a wall thickness of 5-15% of the tubing diameter, although a different wall thickness range may applied dependent on the use of the tubing. It is also known, that coiled tubing can perform many different oil well operations, and these include use in interventions in oil and gas wells, and use as production tubing in gas wells as well.

Application of such coiled tubing in oil and gas operations involves deploying the tubing as support for drill tools for inserting those tools into boreholes or for retrieving those tools from boreholes. Such tools can be packers, valves, sleeves, sensors, plugs, gauges and so on, which have to be run into and retrieved from the boreholes. These tools may find use for servicing the well.

The operations as stated in the preceding paragraph are done through lubricator string sections and those sections serve as a sluice for undertaking such operations.

How a lubricator string functions for insertion of tools into the well and for retrieval of the same therefrom, are all common knowledge in the art and will not be elaborated any further.

When in use, a coiled tubing injector is normally mounted to an elevated platform above a wellhead or is mounted directly on top of a wellhead. A typically coiled tubing injector is comprised of two continuous belt drive chains, though more than two can be used. The belt drive chains are mounted on sprockets to form elongated loops that counter rotate. A drive system applies torque to the sprockets to cause them to rotate. In most injectors, belt drive chains are arranged in opposing pairs, with the pipe being held between the belt drive chains. Grippers carried by each belt drive chain come together on opposite sides of the tubing and are pressed against the tubing. The grippers, when they are in position to engage the tubing, ride or roll along a skate, which is typically formed of a long, straight and rigid beam. The injector thereby continuously grips a length of the tubing as it is being moved in and out of the well bore. Each skate forces grippers against the tubing with a force or pressure that is referred to as a normal force, as it is being applied normal to the surface of the pipe.

A drive system for a coiled tubing injector includes at least one motor. For larger injectors, intended to carry heavy loads, each belt drive chain will typically be driven by a separate motor. The motors are typically hydraulic, but electric motors can also be used. Each motor is coupled either directly to a drive sprocket on which a belt drive chain is mounted, or through a transmission to one or more drive socket.

During development of injector head it has been found that synchronized chain blocks reduces wear on the continuous elongate device (CED) and prevents fatigue of the continuous elongate device.

With two drive motors the belt drive chains are driven independently of each other on each side of the continuous tubing ie. the chains are driven without synchronization gears. There is a constant torque on the motors.

The chain blocks could in the initial position be synchronized ie the chain blocks from the two independent chains are oppositely positioned in the same horizontal plane. Due to slightly different lengths of the chains, different rotation speed of the drive sprockets etc the chain blocks will after a while be unsynchronized, ie the chain blocks from the two independently chains will not be positioned in the same horizontal plane.

The two oppositely chain blocks will grip the continuous tubing at slightly different time.

This will lead to wear and possible fatigue of the continuous tubing because one the first chain blocks on the first chain will engage with the continuous tubing prior to second chain blocks on the second chain. The first chain blocks will also engage the continuous tubing at another angle than the second chain blocks. This results in that the first chain blocks must travel a longer distance than the second chain. The difference is small typically 0.1 mm per meter continuous tubing, but the difference between the chain blocks could accumulate to an alterations of position or the loss of friction between the continuous tubing and the chain blocks.

To compensate for this uneven rotation of the chains, there have been developed injector head where the chain blocks are rotated synchronously during all movement of the continuous tubing in or out of the well. This has been obtained by using toothed wheel that are mounted on each of the chain drive shafts and interconnected so that both chains are rotated at the same speed and have same position. The toothed wheels are synchronized mechanically in order to obtain the chain block in parallel, opposite positions. This synchronizing of the chain could cause wear and fatigue of the continuous tubing and loss of the lifting force. The chains will rotate around the toothed wheel with the same speed in order to maintain the chains in a synchronized position. This leads to large internal forces within the system due to loss of friction between the chain blocks and the continuous tubing. The chain blocks could slip when they are in contact with the continuous tubing and this could cause damage to the continuous tubing. The synchronized toothed wheel and the chain blocks will in this solution have different speed and are working against each other.

In a system without synchronized toothed wheels the chains will rotate with different speed and the chain blocks will not be synchronized after a while. This will lead to wear and possible fatigue of the continuous tubing because the first chain blocks on the first chain will engage with the continuous tubing prior to second chain blocks on the second chain. The first chain blocks will also engage the continuous tubing at another angle than the second chain blocks. This results in that the first chain blocks must travel a longer distance than the second chain. The difference is small typically 0.1 mm per meter continuous tubing, but the difference between the chain blocks could accumulate to an alterations of position or the loss of friction between the continuous tubing and the chain blocks.

OBJECTS OF THE INVENTION

According to one aspect of the present invention it is one objection of the present invention to provide a system that measure the position of two opposite chain blocks position on either side of the continuous tubing relative one another. If the chain blocks are not synchronized, the chains on both sides of the continuous tubing are adjusted in the horizontal direction so that the chain and chain blocks will rotate synchronously at both sides of the continuous tubing.

SUMMARY OF THE INVENTION

In one embodiment of the invention an injector head comprising a pair of oppositely located, cooperatively movable, segmented continuous belt drive chains, said each belt drive chain running over a respective pair of drive sprockets and tension sprockets, wherein a tubing receiving section is defined between the belt drive chains, said tubing receiving section having a tubing section centerline extending through the center of the tubing receiving section, said injector head having an injector centerline extending through the centerline of the injector head, said injector centerline and said tubing section centerline being substantially aligned in the longitudinal direction in an initial position, a pair of elongate counter-force members is positioned at each side of the tubing receiving section. The injector head being distinctive in that said injector head has at least one actuator adapted to move at least one of said elongate counter-force member in order to bring the tubing section centerline out of alignment with said injector centerline.

In another embodiment of the invention an injector head comprising; a pair of oppositely located, co-operatively movable, segmented continuous belt drive chains, said each belt drive chain running over a respective pair of drive sprockets and tension sprockets, said each running belt drive chain comprising an inner flight and an outer flight, said respective inner flight and outer flight extending between said sprockets, at least a portion of said respective inner flights defining a tubing receiving section for a coiled tubing. The invention being distinctive in that said injector head comprising at least one roller arranged in contact with a portion of one of the inner flights, said at least one roller is moveable to displace at least said portion of said inner flight.

Preferable embodiments of the injector head are defined in the dependent claims, to which reference are made.

An exemplary embodiments of the injector head according to the invention comprising a pair of oppositely located, co-operatively movable, segmented continuous belt drive chains, each belt drive chain comprising gripper blocks, said each belt drive chain running over respective pair of sprockets, wherein a tubing receiving section is arranged between the belt drive chains and having a tubing receiving section centerline a pair of elongate counter-force members positioned at each side of the tubing receiving section. The injector head is distinctive in that said injector head having means for moving the elongate counter-force members in a direction along a plane parallel to the tubing receiving section centerline and perpendicular to a rotational axis of the sprocket, and inclined to the tubing receiving section centerline, thereby moving the tubing receiving section centerline in the same direction.

BRIEF DESCRIPTION OF THE INVENTION

Having described the main features of the invention above, a more detailed and non-limiting description of non-limiting embodiments of the conveyor apparatus according to the invention and aspects thereof is given below, with reference to the attached drawings.

FIG. 6*a-f* shows principle drawing of the running of the injection head according to one embodiment of the invention which uses regulators that moves the skate.

Figure 6C:
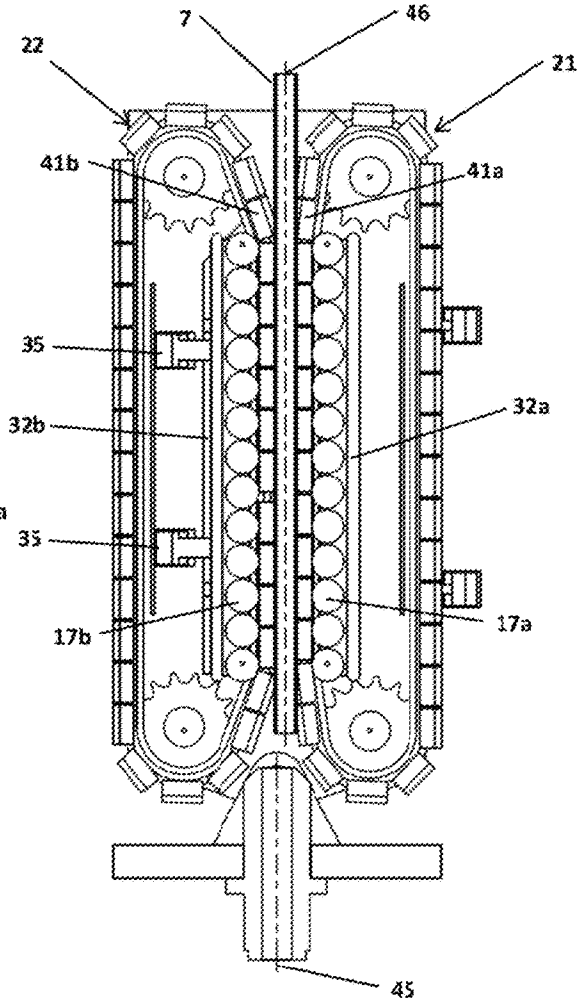
Figure 6B:
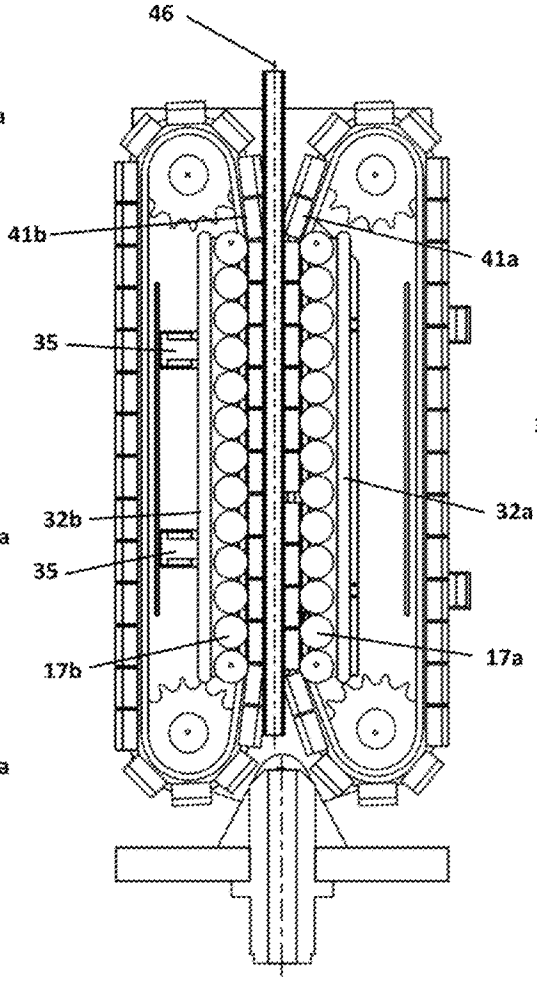
Figure 6A:
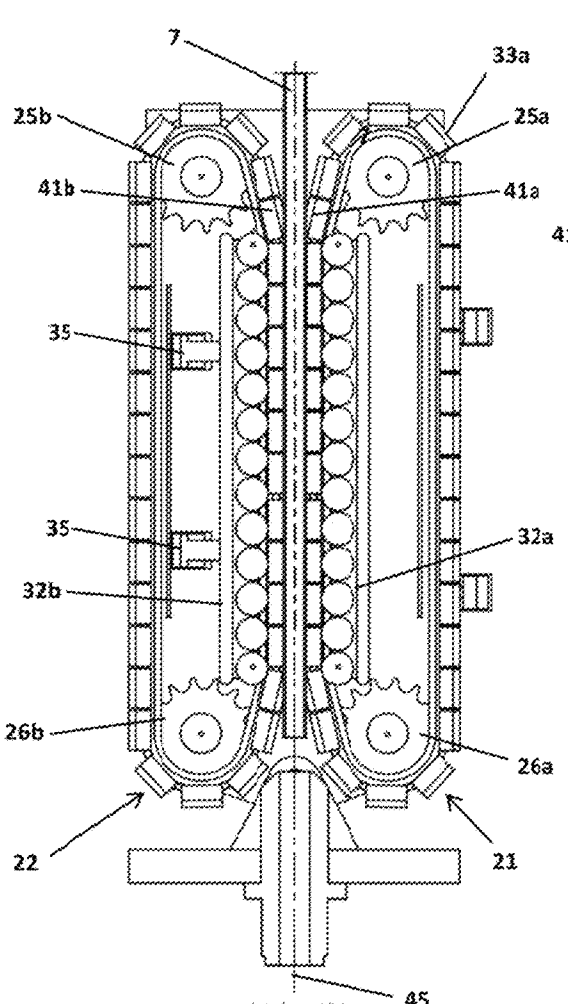

FIG. 6*a*-6*c* shows an injector head with belt drive chains where the roller means are attached to the chain blocks.

Figure 6D:
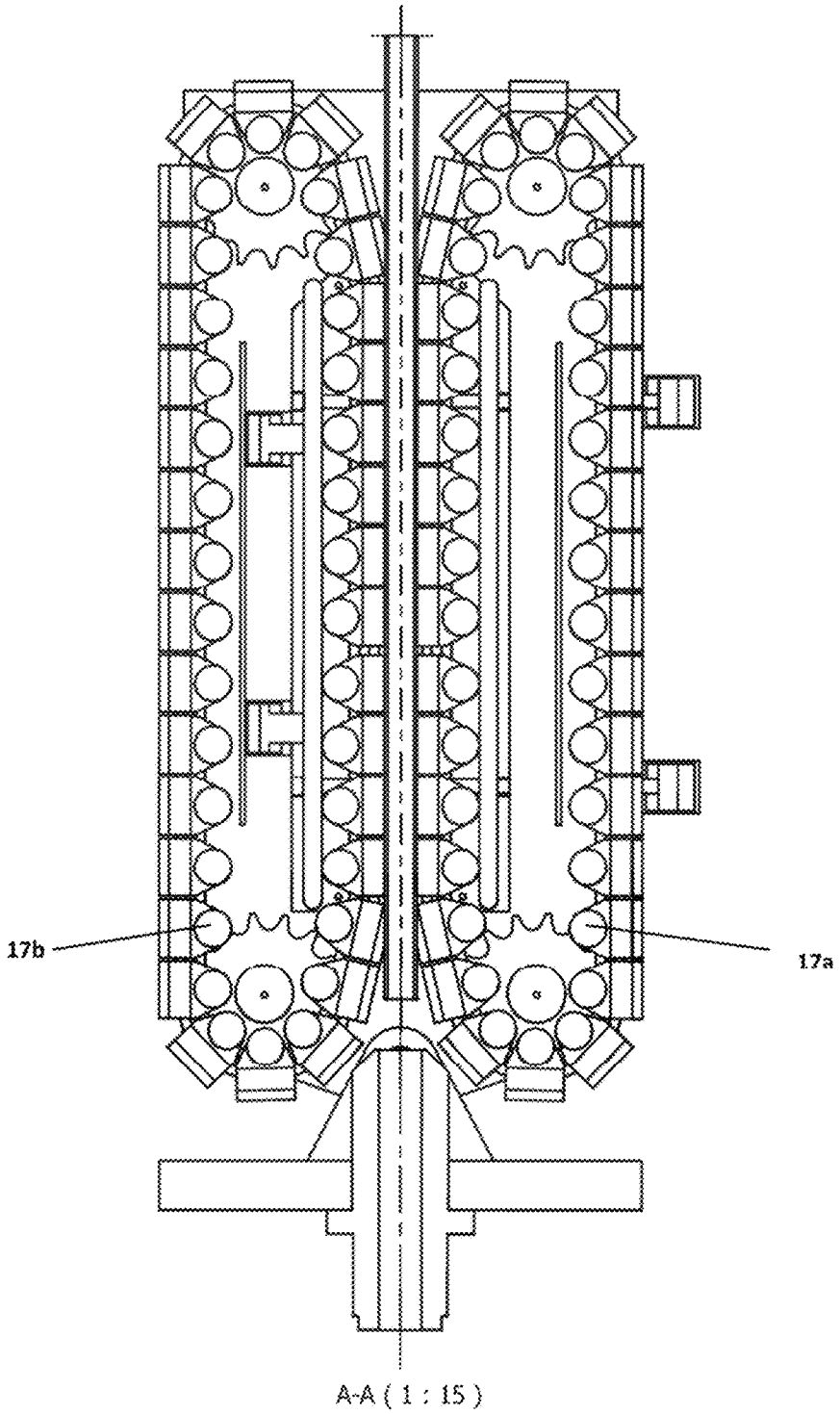

FIG. 6*d* shows an injector head with belt drive chains where the roller means are attached to the skate.

FIG. 7*a*-7*d* shows a principle drawing of the running of the injector head according to another embodiment of the invention where there are arranged separate regulators on each side of the skates which have the purpose of maintaining the same position between the skate and move the skate in the horizontal direction.

Figure 8B:
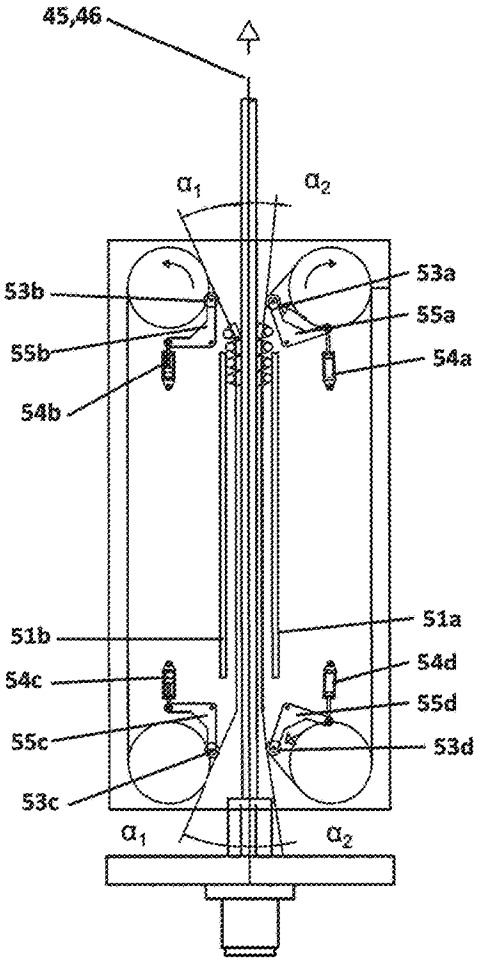
Figure 8A:
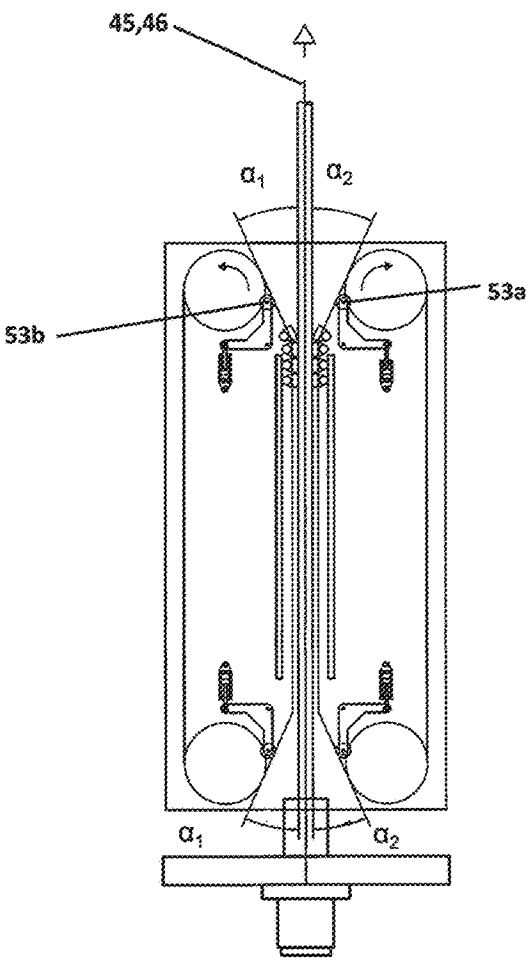

FIG. 8*a*-8*b* shows a principle drawing of another embodiment of the invention with at least on roller moving a portion of the belt drive chain.

Figure 9:
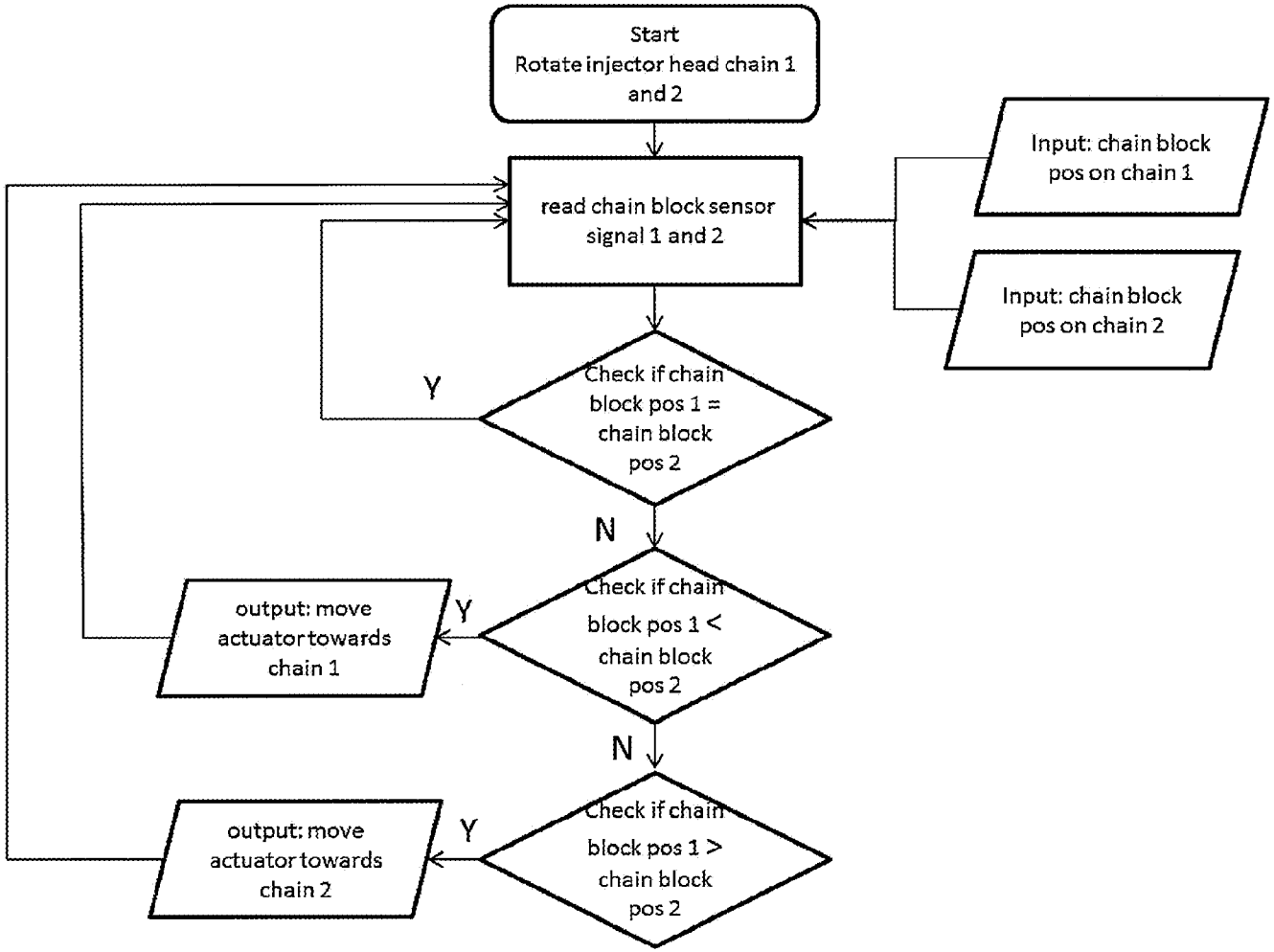

FIG. 9 shows a block diagram of the adjusting process of the chain in the injector head.

Figure 10B:
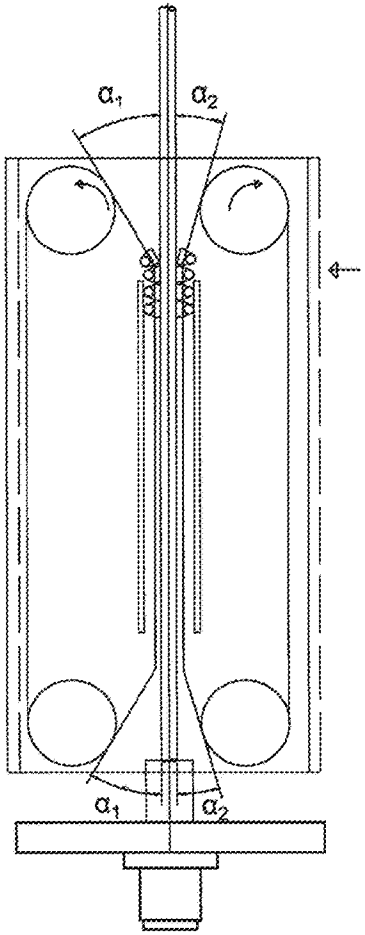
Figure 10A:
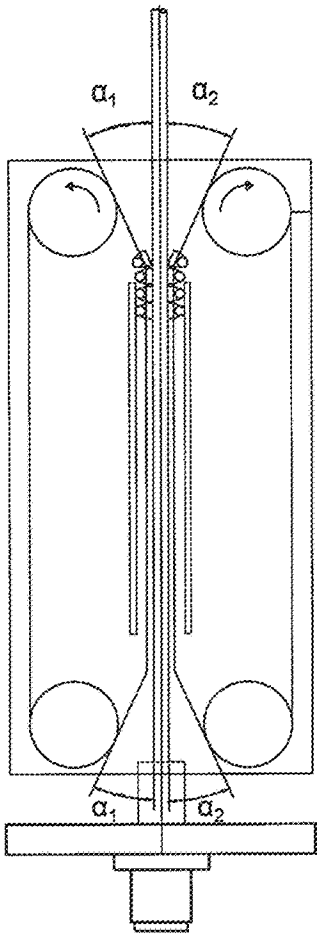

FIGS. 10*a* and 10*b* shows a principle drawing of an embodiment of the invention where the injector head drive unit is moved.

DETAILED DESCRIPTION OF THE INVENTION

The following describes preferred embodiments of the conveyor apparatus of the present invention and which is exemplary for the sake of understanding the invention and non-limiting.

In the present context, the term "injector head" is to be construed as being synonymous with the term conveyor apparatus as defined in the claims.

Further, the term "counter-force member" is synonymous with the term "skate" frequently used in the art.

All throughout the specification including the claims, the words "continuous tubing", "skate", "belt drive chain", "actuator", "coiled tubing", "borehole", "wellhead", "lubricator strings", "bearing", "BOP", "injector head", "sensor", "control system", "roller" are to be interpreted in the broadest sense of the respective terms and includes all similar items in the field, known by other terms, as may be clear to persons skilled in the art.

Restriction/limitation, if any, referred to in the specification, is solely by way of example and understanding the present invention. More specifically, hereinafter, the term "coiled tubing" has been referred to for the sake of convenient understanding of the invention. It should be understood that "coiled tubing" also includes other similar continuous tubing as may be known to persons skilled in the art of the present invention. Further, it will be appreciated by the expert in the art that the invention is also applicable to other continuous elongate devices (CED's), such as rods, wires or wirelines.

Although the injector head is, in a currently preferred mode of operation, primarily to be used for operation with coiled tubing, the use of the injector head in conjunction with other CED's lies within the scope of the invention.

It should also be understood that the orientation of some of the apparatus components may exhibit configurations other than those shown in the drawings, without deviating from the principle of the invention, and such different configurations which to not affect the overall operation of the apparatus are to be construed as merely technical equivalents within the scope of the present invention. The term upper and lower are used only to simplify the description of the invention.

The various essential aspects of the injector head will now be described in more detail with reference to FIGS. 1-9.

The figures illustrate the same representative injector but with different examples of the synchronization.

The injector head 2 enables the injection of a continuous tubing 7 down through the injector head 2 and then through a lubricator strings (not shown) located between the apparatus 2 and the wellhead (not shown), suitably via a BOP (blow out preventer) to enable insertion of tools (not shown) in the wellhead and further into a well below (not shown) or up through the injector head 2 by pulling action enabling retrieval of the tool from the wellhead and the well below.

Figure 1:
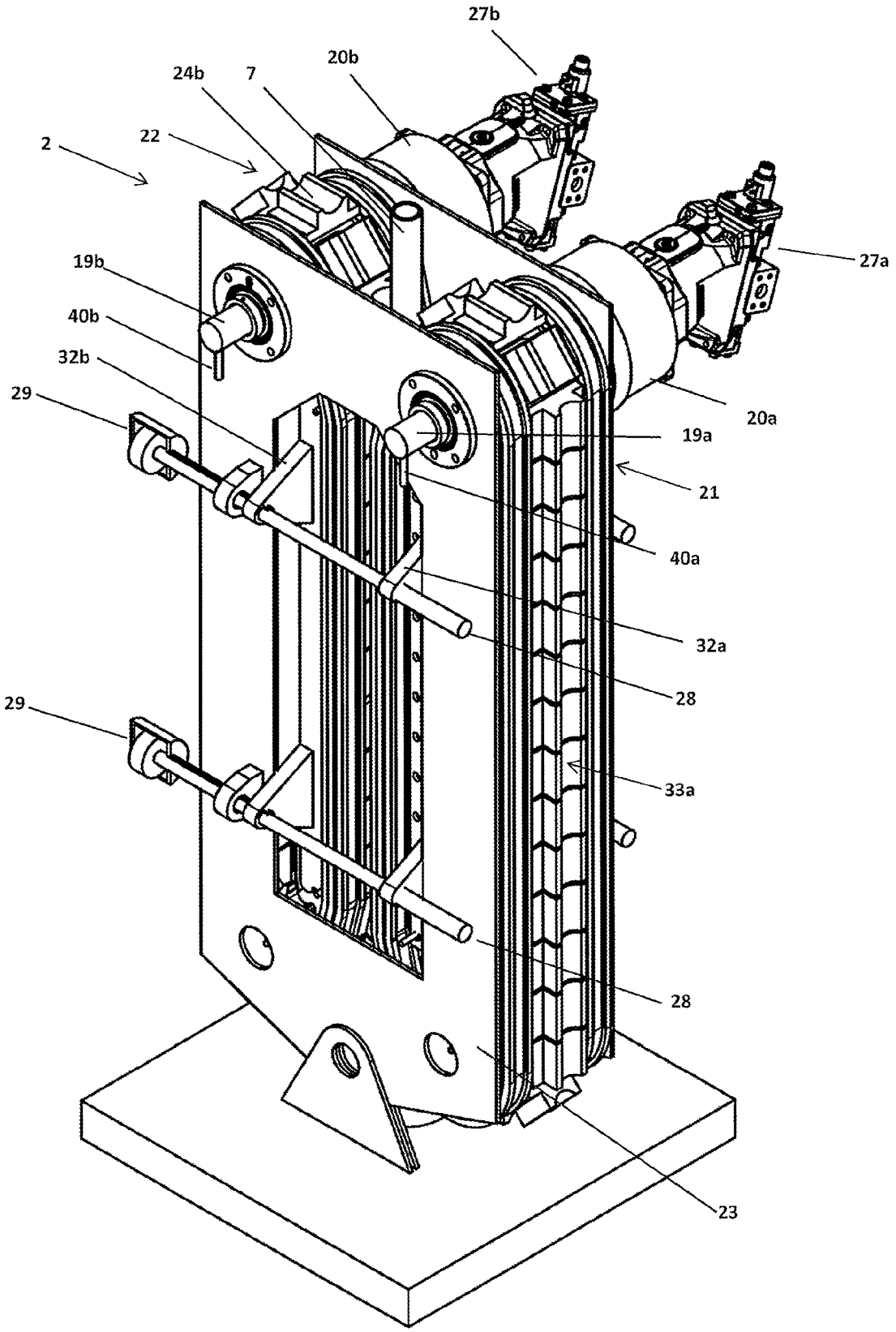
FIG. 1 is a principle view of the injector head according to an embodiment of the invention.

FIG. 1 shows a perspective view of the injector head 2. All the details of the invention is not present but it is a simplified drawing of a typical injector head 2 according to the invention.

The injector head 2 comprising a pair of upright, cooperatively movable, segmented, continuous belt drive chains 21, 22. The first continuous chain 21 and the second continuous chain 22 are oppositely located and installed in a frame 23. The chains 21, 22 form parts of two separate chain system arranged on both sides of the continuous tubing 7.

Figure 3:
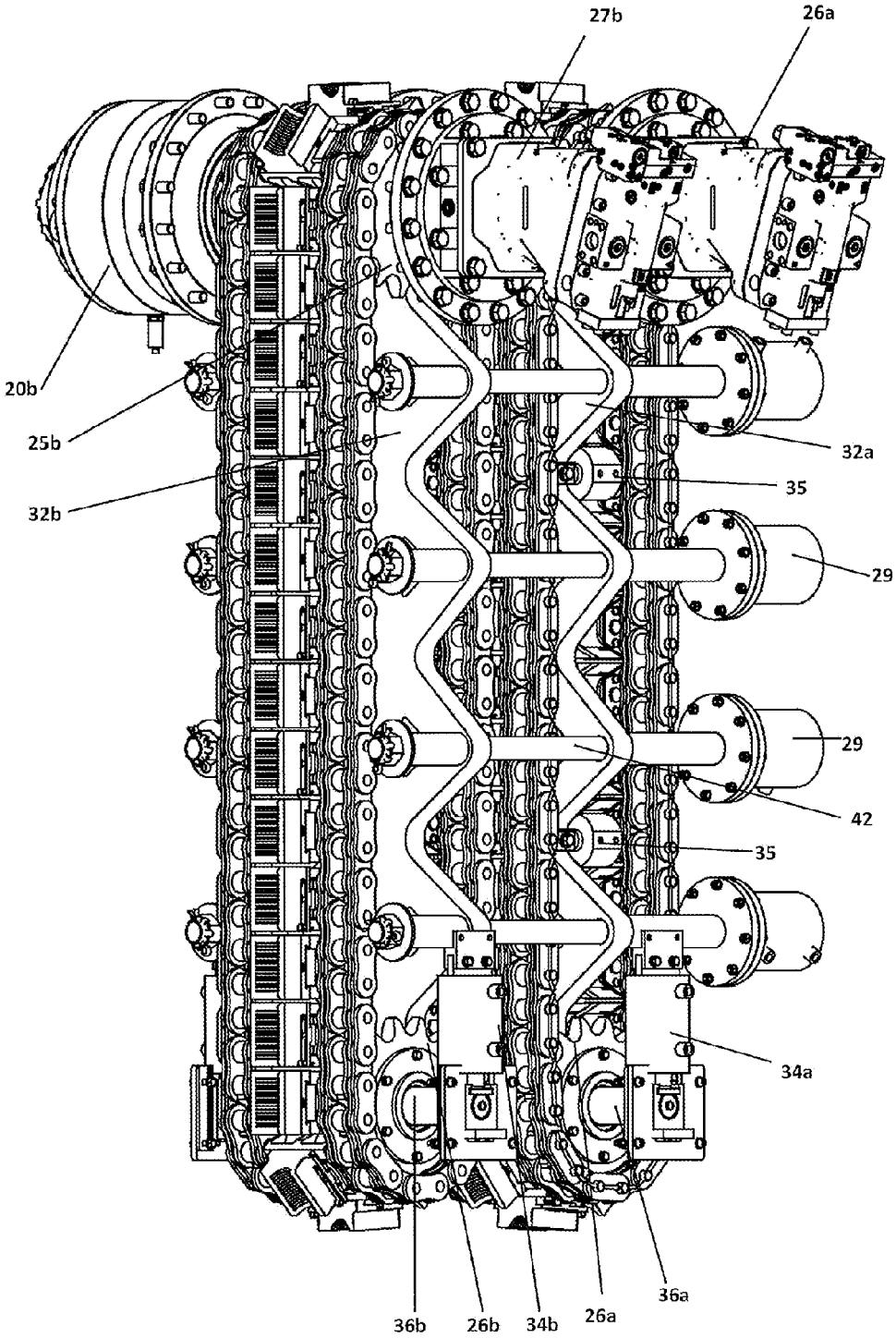
FIG. 3 is a perspective view of the injector tube according to the invention shown without the frame.

Each of the chain 21, 22 comprises a plurality of interconnected tubing chain blocks 24*a*, 24*b* and are respective running over a chain drive sprockets 25*a*, 25*b* and a tension sprocket 26*a*, 26*b*. In the figure it is shown that the tension sprocket 26*a*, 26*b* is arranged beneath the drive sprocket 25*a*, 25*b*. (FIG. 3). Each of the sprockets 25*a*, 25*b* is connected to a chain drive and a powerful torque creating motor 27*a*, 27*b*. The motor 27*a*, 27*b* is suitably a hydraulic motor, but could just as well be an electric or pneumatic motor. A gear 20*a*, 20*b* is also arranged in connection with each of the motors 27*a*, 27*b*.

The motors 27*a*, 27*b* and gears 20*a*, 20*b* are each connected to in one end to a drive shaft 19*a*, 19*b* extending through each of the drive sprockets 25*a*, 25*b*.

At the opposite end of the drive shaft there is arranged a sensor 40*a*, 40*b*. There are arranged at least one sensor, but in the figure there are shown two sensors 40*a*, 40*b*. The sensors could measure the position of two oppositely positioned chain blocks 24*a*, 24*b* attached to the first chain 21 and second chain 22. The sensor cooperates with a control system and adjusting means to correct the positioning of the opposite chain blocks. The sensor could for instance be a chain speed encoder which converts the angular position or motion of the shaft to an analog or digital code.

The invention is applicable with injector heads running without synchronization gear. The constant torque on the motors gives different speed on the first chain 21 and second chain 22. The sensors or chain speed encoder 40*a*, 40*b* will then register the speed and a regulator will adjust the position of the skate 32*a*, 32*b* which lead to synchronized chain blocks 24*a*, 24*b*.

The invention is also applicable with toothed drive sprockets which are attached together to drive the belt drive chains synchronously, ie injector head running with synchronized gear. With the chain running with constant torque on motors the synchronization gear will synchronize the chain blocks 24*a*, 24*b*, sensors ie shaft torque sensors 40*a*, 40*b* will register torque differences and a regulator will adjust the center position of the skate.

A first counterforce elongate member 32*a* is extending between said drive sprocket 25*a* and tension sprocket 26*a* and a similar second counterforce elongate member 32*b* is extending between said drive sprockets 25*b* and said tension sprocket 26*b*. The first and second elongate member are arranged on each side of the continuous tubing 7 and in contact with each of the respective chains 21, 22. The longitudinal space between the chains 21, 22 where the continuous tubing are led through is defined as a tubing receiving section 7'. The first and second counterforce elongate member 32*a*, 32*b* will hereinafter be called "skates".

The provision of the skates 32*a*, 32*b* is to make sure that a gripper block 33*a*, 33*b* attached to the chain block 24*a*, 24*b* sufficiently engages the continuous tubing 7 when it is forcibly driven through the injector head 2.

In order to adjust the transverse position of both skates and their mutual distance there is provided a plurality of clamping force devices 28 in the transverse position of the skate 32*a*, 32*b* and the continuous tubing 7. These clamping force devices 28 having at least one actuator 29, preferably one actuator 29 connected to each of the clamping force devices 28. This could for instance be a hydraulic cylinder or ram. The clamping force device 28 have also customized elongate rods 30. These racks or rods 30 are extending on either transverse side of the chains 21, 22 and powered by the at least one actuator 29.

Figure 2:
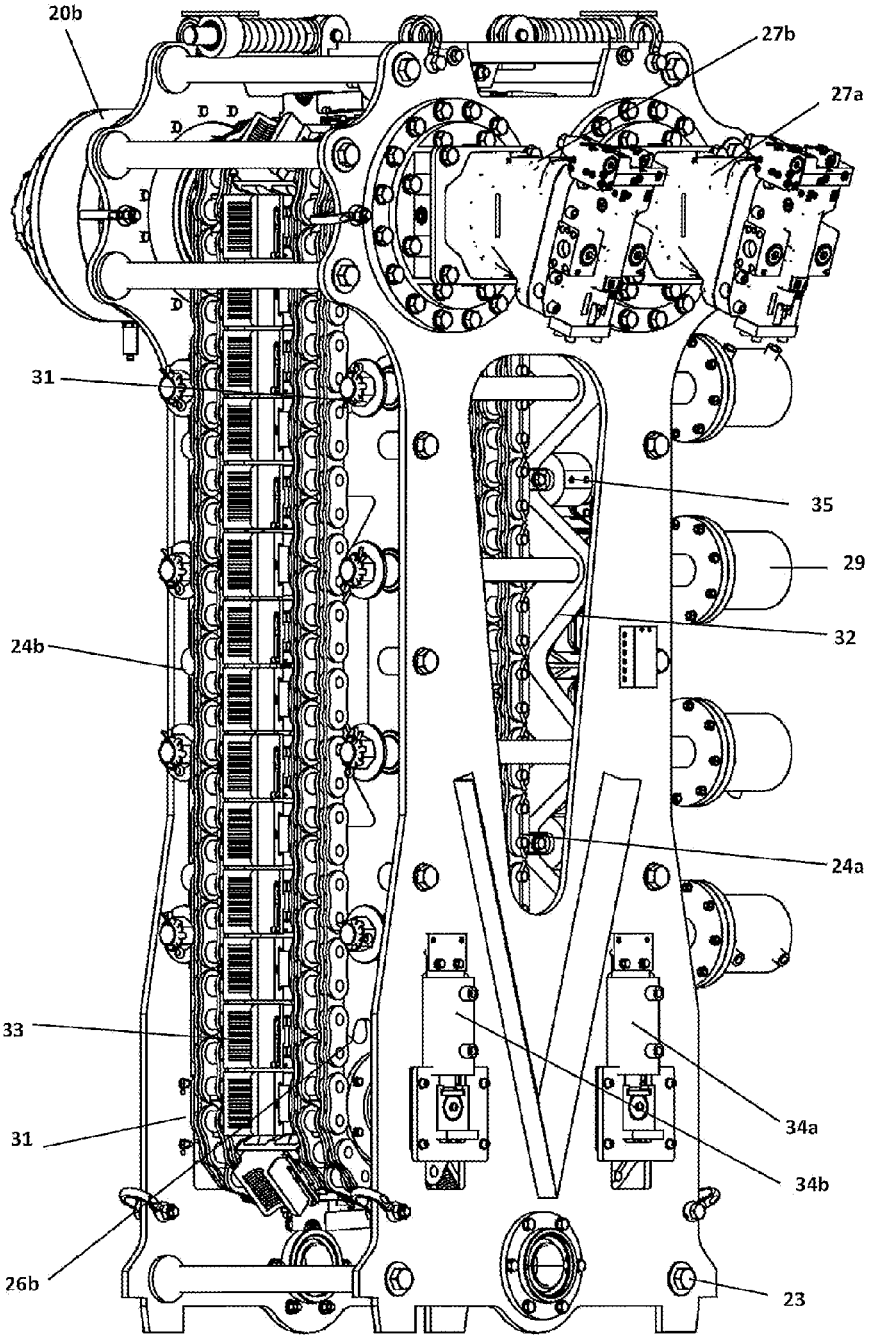
FIG. 2 is a perspective view of the injector tube according to the invention.
Figure 4:
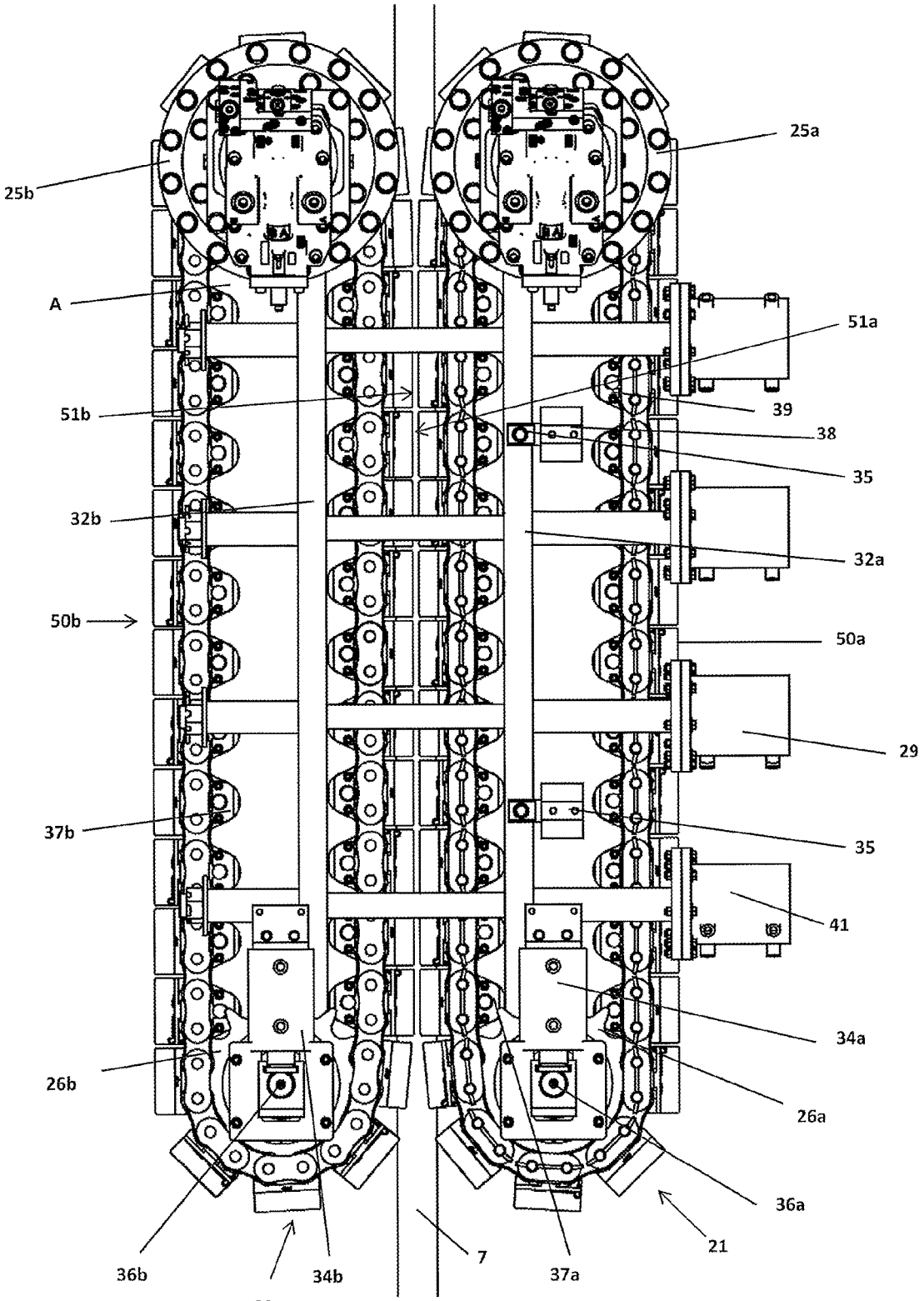
FIG. 4 is a sectional view of the injector tube according to the invention shown without the frame.

In FIGS. 2, 3 and 4 the injector head according to the invention is shown in greater detail. In FIGS. 3 and 4 the injector head is shown without the frame 2. Each of the chain blocks 24*a*, 24*b* comprises interconnected tubing gripper shoe carriers 37*a*, 37*b* with roller means (not shown) configured to roll in the longitudinally direction of the skate 32*a*, 32*b* on each side of the tubing 7. The tubing gripper shoe carriers 37*a*, 37*b* arranged on the opposite side of the gripper block 33*a*, 33*b*. The chain block 24*a*, 24*b* comprising the shoe carrier 37*a*, 37*b* and the gripper block 33*a*, 33*b*.

The figures further shows a pressure device 34*a*, 34*b* attached to each of the chain systems. The pressure device 34*a*, 34*b* is in one end connected to a shaft 36 through the respective tension sprocket 26*a*, 26*b* and in the other end connected to the frame 2. The purpose of the pressure device is to make sure that the chain 21, 22 is held tightly around each of the respective sprockets 25*a*, 26*a* and the sprockets 25*b*, 26*b* by pushing the sprocket 26*a*, 26*b* downwards and to avoid slack in the chain 21, 22. The pressure device 34*a*, 34*b* comprises for instance a tension cylinder that regulates the distance between the tension sprocket 26*a*, 26*b* and the frame 23 in the vertical direction.

Another purpose of the pressure device 34*a*, 34*b* is to allow a little movement of the chain 21, 22 when one of the chain 21, 22 is moved towards an injector head centerline 45. This will be described further below.

Position sensors 40*a*, 40*b* are attached to an end of a shaft extending through each of the upper sprocket 25*a*, 25*b*. The position sensors could also be attached to other parts of the injector head suitable for measuring the position, angle difference, speed or torque etc. of the opposite chain 21, 22 or chain blocks 24*a*,24*b*.

The purpose of the sensors 40*a*, 40*b* is to measure the position, torque difference, speed difference, angle difference etc of the chain blocks 24*a*, 24*b* on each side of the tubing receiving section 7'. The chain blocks 24*a*, 24*b* and consequently the gripper blocks 33*a*, 33*b* are synchronized when the chain blocks 24*a*, 24*b* on each side of the tubing receiving section 7' are positioned in the same horizontal plane. There are different ways to measure the position of two oppositely arranged chain blocks 24*a*, 24*b*. This could for instance be performed by measuring two opposite chain blocks 41*a*, 41*b* that initially engage with the continuous tubing 7, that is what angle or speed the initial chain blocks 41*a*, 41*b* engage with the continuous tubing 7 and difference between the two opposite initially chain blocks 41*a*, 41*b*.

Figure 5:
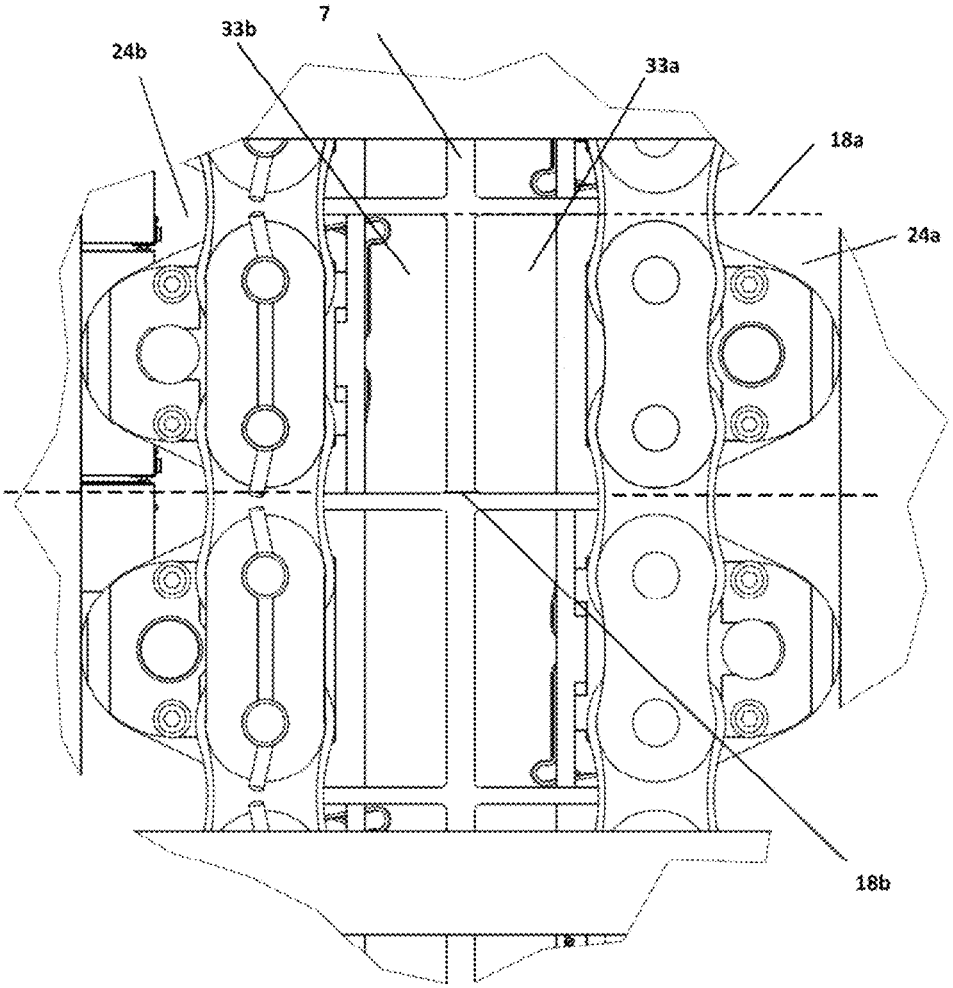
FIG. 5 is a detailed view of synchronized chain blocks.

Synchronized chain blocks 24*a*, 24*b* are shown in FIG. 5. To be synchronized the top of the chain blocks 24*a*, 24*b* are arranged in a same plane 18*a* extending through the top boundary of a pair of chain blocks 24*a*, 24*b* arranged on the two opposite chains 21, 22. The bottom of the chain blocks 24*a*, 24*b* are also arranged in the same plane 18*b* extending through the bottom boundary of the chain blocks 24*a*, 24*b*. The plane 18*a* and 18*b* are substantially parallel. The gripper block 33*a*, 33*b* of each chain blocks 24*a*, 24*b* will in this position engage equally with both sides of the continuous tubing 7.

When the tubing 7 is pulled or pushed through the injector head 2, one of the gripper block 33*a*, 33*b* attached to the first or second chain 21, 22 will tend to engage with the continuous tubing 7 before the corresponding gripper block 33*a*, 33*b* attached to the opposite first or second chain 21, 22. This will after a while lead to unsynchronized chain blocks 24*a*, 24*b*. This again could result in wear and fatigue on the tubing.

The chains 21, 22 are unsynchronized when the chain blocks 24*a*, 24*b* are not arranged in the same plane 18*a*, 18*b* when interconnecting with the continuous tubing 7.

In order to maintain the chain blocks 24*a*, 24*b* to be synchronized throughout the whole feeding/pulling of the continuous tube 7, there are arranged at least one inner adjustment actuator 35. The at least one inner adjustment actuator 35 are in the FIGS. 2, 3 and 4 attached to one of the skates 32*a*, 32*b*. There could be several inner adjustment actuator 35 attached to one of the skates 32*a* or the skate 32*b* or both.

In the figures there are shown two inner adjustment actuator 35 attached to the second skate 32*b* but there could be more than two or just one adjustment actuator 35. The inner adjustment actuator 35 could optionally be attached to the first skate 32*a*. The inner adjustment actuator 35 could for instance be hydraulic, pneumatic or electric driven and has the purpose of moving the skate 32*a*, 32*b* attached to the inner adjustment actuator 35 towards the tubing 7 or away from the tubing 7. The tubing 7 will then be moved accordingly in the transverse direction. The skates 32*a*, 32*b* are fixed by the clamping force device 28 in a distance corresponding to the continuous tubing from each other. The second skate 32*b* will move accordingly of the first skate 32*a* in the same direction.

FIG. 6*a-c* shows the principle of the running of the injection head 2 according to one embodiment of the invention.

In FIG. 6*a* the chain blocks 24*a*, 24*b* and the corresponding gripper blocks 33*a*, 33*b* are in a synchronized position. In this position a tubing section centerline 46 extending through the center of the tubing receiving section 7' are aligned and congruent to an injector centerline 45 extending through the centerline of the injector head 2. This could be a start or initial position of the pulling/pushing of the tubing 7 in the injector head 2.

The tubing section centerline 46 is defined by the centerline of the space between the first chain 21 and second chain 22 where the continuous tubing 7 is normally positioned when pushed or pulled into or out of the well.

In FIG. 6*b* the gripper block 33*a* of the first chain 21 tend to engage the continuous tubing 7 slightly prior to the gripper block 33*b* of the second chain 22. To prevent the gripper blocks 33*a*, 33*b* and the chain blocks 24*a*, 24*b* to have unsynchronized positions, the inner adjustment means 35 pulls the second skate 32*b* and therefore also the chain blocks 24*a*, 24*b* interconnecting the continuous tubing 7, the tubing 7 and the first skate 32*a*, towards the adjustment means 35. The tubing section centerline 46 is moved away from the injector centerline 45. (In the FIG. 7*b* the skates 32*a*, 32*b* and the continuous tubing 7 are moved to the left from the centerline 45 of the injector head 2.) The drive sprocket 25*a* and the tension sprocket 26*a* are not moved in the horizontal direction. Since only the first chain blocks 24*a* abutting the continuous tube 7 is moved to out of position this will lead to a movement of the tension sprocket 26*a* in the vertical direction as a compensation because the circumference of the chains 21, 22 have to be the same in all positions of the chain 21, 22.

Figure 7D:
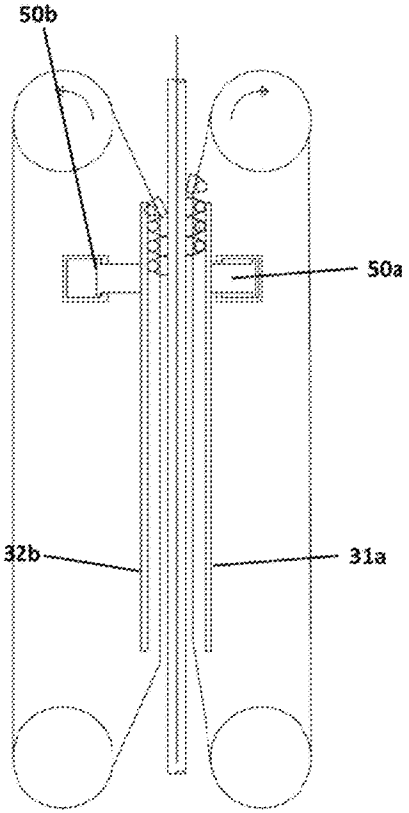
Figure 7C:
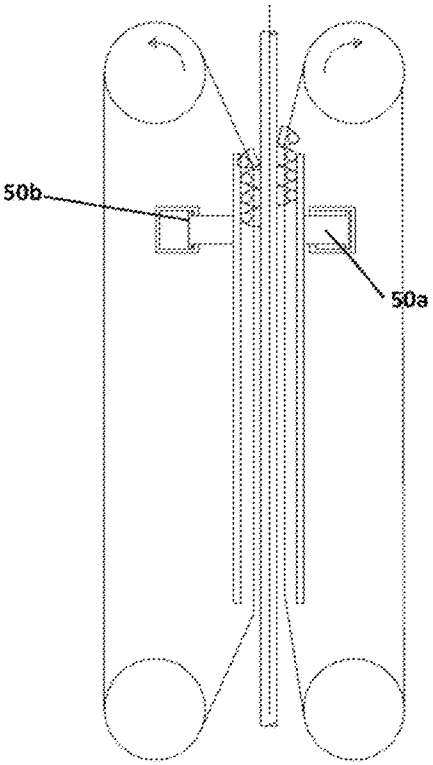
Figure 7B:
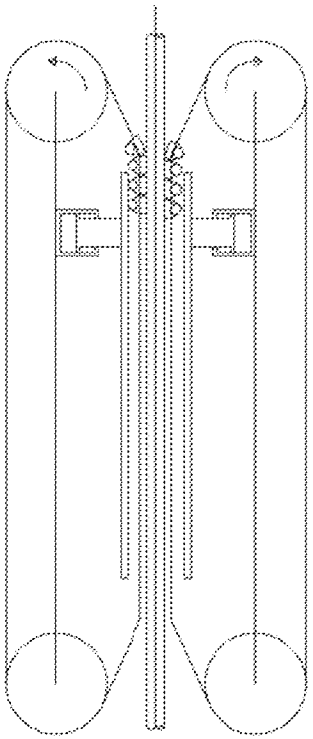
Figure 7A:
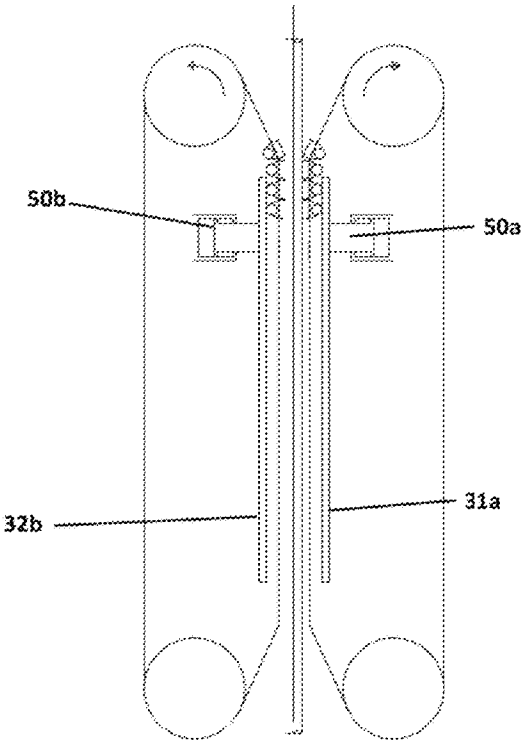

When the skates 32*a*, 32*b* together with the continuous tubing 7 and the chain blocks 24*a*, 24*b* are shifted to the position shown in FIG. 7*b*, the gripping shoes 33*a* of the chain blocks 24*a* on the first chain 21 will have a slightly longer distance to rotate from the position on top of the drive sprocket 25*a* to the engagement with the continuous tubing 7.

The gripper block 33*b* attached to the chain block 24*b* on the second chain 22 will correspondently have a shorter distance from the top of the sprocket 25*b* to a position where it engages with the continuous tubing 7. The inner adjustment actuator(s) 35 will position the skates 32*a*, 33*b* in a position so that the gripper blocks 33*a*, 33*b* on two oppositely corresponding chain blocks 24*a*, 24*b* are engaging the continuous tube 7 on opposite sides of the tube 7 synchronously.

FIG. 6*c* shows the opposite case than in FIG. 6*b*. The gripper block 33*b* of the second chain 22 tend to engage with the continuous tubing slightly prior the gripper block 33*a* of the first chain 21. To compensate for this and to achieve synchronized chains 21, 22 the adjustment actuators are moving the second skate 32*b* connected to the adjustment actuator 35 away from the adjustment actuator 35. The first skate 32*a*, the continuous tubing 7 and the gripper block 33*a*, 33*b* of the chain blocks 24*a*, 24*b* abutting the continuous tubing 7 are moved correspondently in the same direction. The tubing section centerline 46 is moved away from the injector centerline 45 (In FIG. 7*c* the first and second skates 32*a*, 32*b* and the continuous tubing 7 are moved to the right out of alignment of the injector centerline 45.

The skates 32*a*, 32*b* and chains 21, 22 in FIGS. 6*b* and 6*c* are moved in a direction along a plane parallel to the tubing receiving section centerline and perpendicular to a rotational axis of the sprockets (25*a*, 26*a*).

To compensate for the difference between the gripper blocks 33*a*, 33*b*, there are arranged a pair of sensors 40*a*, 40*b* which could measure an initial gripping shoes 41*a*, 41*b* that initially engages with the continuous tubing 7. The sensors 40*a*, 40*b* could also measure other different parameters in order to analyze if the chain blocks 24*a*, 24*b* for instance the initially gripper blocks 41*a*, 41*b* are synchronized or not.

The different parameters could be for instance measure of the speed or difference in the angle of the initially gripper blocks 41*a*, 41*b*. The sensor 40*a*, 40*b* could also measure the torque difference on the drive shaft 19*a*, 19*b* for instance if the injector head are running with synchronized gear, as described earlier.

The sensors 40*a*, 40*b* are connected to a control system (not shown) cooperating with the actuator. Based on the measurement of the sensor the actuator will compensate for any unsynchronized movement of the chains by moving the skates in the horizontal direction.

There are two different types of skates. These are illustrated in the FIG. 6*a-c* and FIG. 6*d*.

In FIG. 6*a*-6*c* the roller means 17*a*, 17*b* are connected to the skate 32*a*, 32*b* and that the tubing gripper shoe carriers 37*a*, 37*b* attached to the chain 21, 22 having an even surface where the roller means 17*a*, 17*b* are configured to be in contact with and roll on.

FIG. 6*d* shows the other principle which are described earlier, where the roller means 17*a*, 17*b* are connected to the belt drive chain 21, 22.

Figure 6F:
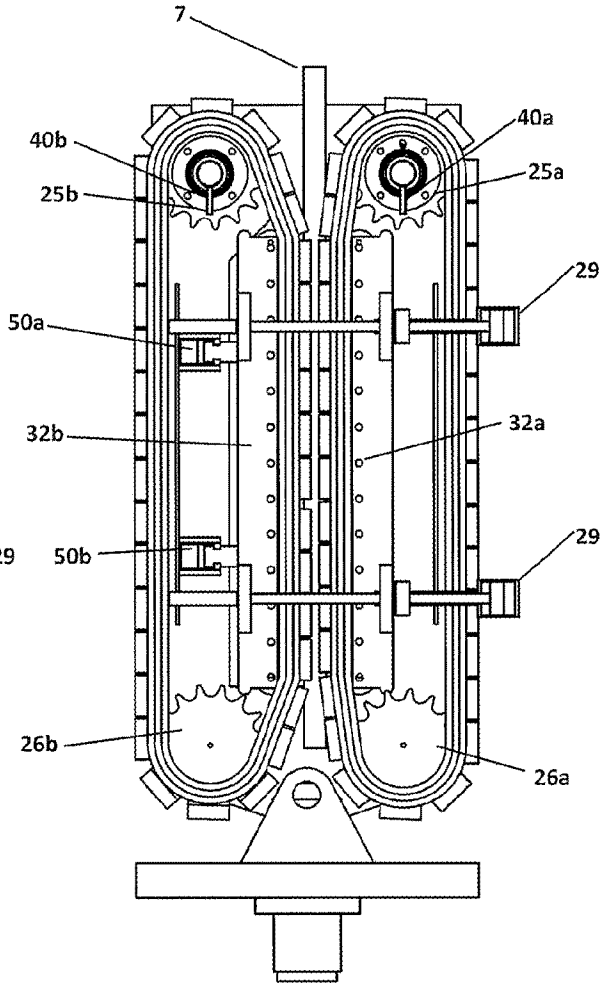
Figure 6E:
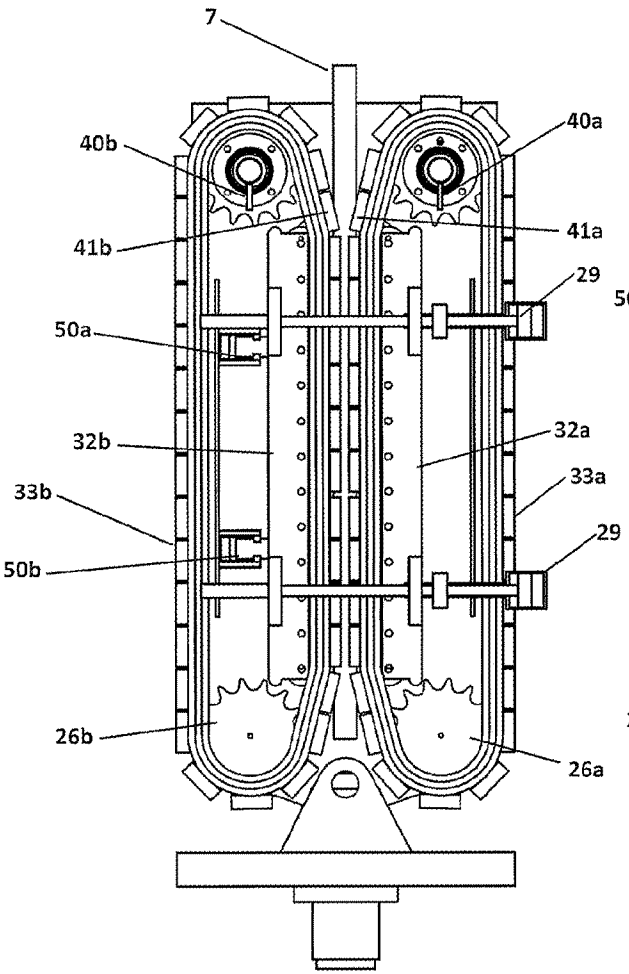

In FIGS. 6*e* and 6*f*, the possible position of the sensors 40*a*, 40*b* are shown.

FIG. 7*a*-7*d* shows a principle drawing of another embodiment of the running of the injector head according to the invention.

In this figures the inner adjustment actuator and the clamping force device which are described as independently actuator in the previous embodiment, are arranged in the same adjusting device 50*a*, 50*b*. There are arranged at least one adjusting device 50*a*, 50*b* on each side of the continuous receiving section 7. A first adjusting device 50*a* is connected to the first skate 32*a* and a second adjusting device 50*b* is connected to the second skate 32*b*. The figure only shows one adjusting device on each side of the skates 32*a*, 32*b*, but there could be more than one adjusting device 50*a*, 50*b* attached to each of the skates 32*a*, 32*b*.

The function of the embodiment of FIG. 7*a*-7*d* is in principle the same as in FIG. 6*a*-6*c* but instead of one active skate which is moved by the adjustment actuator 35 in FIG. 6*a-c* there are similar adjustment devices 50*a*, 50*b* that both can actively position the skates 32*a*, 32*b*. If the chain blocks 24*a*, 24*b* are not running synchronously, the adjusting devices 50*a*, 50*b* will compensate for this by actively moving the first or second skate 32*a*, 32*b* so that the chain blocks 24*a*, 24 are synchronized. They are interacting so that the clamping force between the skates 32*a*, 32*b* are maintained.

FIG. 8*a*-8*b* shows another possible embodiment of the invention.

The chains 21, 22 comprises of an inner flight 51*a*, 51*b* which are extending from the drive sprockets 25*a*, 25*b* two the tension sprocket 26*a*, 26*b*. At least a part of the inner flight 51*a*, 51*b* is engaging or gripping the continuous tubing 7 that are pushed of pulled through the injector head 2.

The outer part of the chain 21, 22 is referred to as an outer flight 52*a*, 52*b*. The outer flight 52*a*, 52*b* is extending from the tension sprocket 26*a*, 26*b* to the drive sprocket 25*a*, 25*b* on the outside of each of the inner flights 51*a*, 51*b*.

In these figures there are arranged first rollers 53*a*, 53*b* in connection with the upper portion 54*a*, 54*b* of the inner flights 51*a*, 51*b* and additionally there are arranged second rollers 53*c*, 53*d* in the lower portion 55*a*, 55*b* of the inner flight 51*a*, 51*b*. The upper and lower portion of the inner flights are the part of the chains restricted respectively between the drive sprockets 25*a*, 25*b* and the upper part of the skate 32*a*, 32*b* and the lower part of the skate 32*a*, 32*b* and the tension sprocket 26*a*, 26*b*.

The rollers 53*a*, 53*b*, 53*c*, 53 are connected to actuators that will move the rollers towards the injector centerline 45 and therefore also move the upper and/or lower portion of the inner flights 51*a*, 51*b* towards the injector centerline 45. They could for instance be connected to the actuators through brackets 55*a*, 55*b*, 55*c*, 55*d*

The skates 32*a*, 32*b* are in this embodiment held in a fixed position. Likewise, the outer flights 51*a*, 51*b* will have a fixed distance to the injector centerline 45 and will not move in relation to this.

The rollers 53*a*, 53*b*, 53*c*, 53*d* could be moved independently of each other.

In FIG. 8*a* there is shown a position where the roller are positioned at an equal distance from the injector centerline 45.

An angle $\alpha 1$ which is defined as the angle between the first chain 21 and the injection centerline. An angle $\alpha 2$ is defined as the angle between the second chain 22 and the injection centerline, The angle $\alpha 1$ and angle $\alpha 2$ are in this position equal.

In FIG. 8*b* the roller 53*a*, 53*d* which are in communication with the first chain 21 are moved towards the injector centerline 45 so that the angle $\alpha 1$ is smaller than the angle $\alpha 2$ to compensate for unsynchronized movement of the chains. Similarly could the rollers 53*b*, 53*c* which are in communication with the second chain 22 move towards the injector centerline 45 so that the angle $\alpha 2$ is smaller than the angle $\alpha 1$.

The same applies for the previous mentioned embodiments where the skate 32*a*, 32*b* or the whole injector drive unit is moved. The angle $\alpha 1$ or $\alpha 2$ will decrease according to the movement of the skates 32*a*, 32*b* or injector drive unit. This embodiment where the whole injector drive unit is moved is shown in FIGS. 10*a* and 10*b*.

FIG. 9 is a block diagram of the adjusting process of the chain in the injector head. The adjusting process is a continuous process to secure that the chains 21, 22 are running synchronously throughout the injection process. The sensors will monitor when the chains 21, 22 are unsynchronized and send signal to the actuator 35, 50*a*, 50*b*,

54*a*, 54*b*, 54*c*, 54*d* to adjust the position of the skates 32*a*, 32*b* or rollers 53*a*, 53*b*, 53*c*, 53*d* if two oppositely orientated chain blocks are not synchronous.

The movement of the actuators depends on which of the chains 21, 22 that needs to be adjusted and brought into synchronization with the other.

The present invention has been described with reference to preferred embodiments and aspects thereof and related to the accompanying drawings for the sake of understanding only and it should be obvious to persons skilled in the art that the present invention includes all legitimate modifications within the ambit of what has been described hereinbefore and claimed in the attached claims.

The invention claimed is:

1. An injector head comprising:

a pair of oppositely located, cooperatively movable, segmented continuous belt drive chains, each belt drive chain of the pair of belt drive chains running over a respective pair of drive sprockets and tension sprockets;

wherein a tubing receiving section is defined between the pair of belt drive chains, said tubing receiving section having a tubing section centerline extending through a center of the tubing receiving section, said injector head having an injector centerline extending through a centerline of the injector head, said injector centerline and said tubing section centerline being substantially aligned in a longitudinal direction in an initial position;

a pair of elongate counter-force members positioned on opposite sides of the tubing receiving section;

wherein said injector head comprises a first actuator adapted to move a first elongate counter-force member of the pair of elongate counter-force members in order to bring the tubing section centerline out of alignment with said injector centerline, said first actuator being connected to the first elongate counter-force member in order to actively move the first elongate counter-force member a distance away from said injector centerline; and wherein a second elongate counter-force member of the pair of elongate counter-force members is moved an equal distance away from said injector centerline in order to compensate for any unsynchronized movement of the pair of belt drive chains.

2. The injector head according to claim 1, further comprising a second actuator oppositely disposed from the first actuator and connected to the second elongate counter-force member, said first and second actuators adapted to actively move the first and second elongate counter-force members an equal distance in a same direction that is transverse to the injector centerline.

3. The injector head according to claim 2, wherein the first and second actuators are configured to set a clamping force between the pair of elongate counter-force members.

4. An injector head according to claim 1, wherein said injector head further comprises at least one sensor for monitoring a position of oppositely arranged chain blocks that are in contact with a continuous tubing while the continuous tubing passes through the injector head.

5. An injector head according to claim 4, wherein the sensor is a shaft torque sensor arranged to register a torque difference between the pair of drive sprockets.

6. An injector head according to claim 4, wherein the sensor is adapted to monitor the position, in a plane transverse to a longitudinal direction of the tubing passing through the injector head, of the two oppositely arranged chain blocks that are initially in contact with the tubing.

7. An injector head according to claim 4, wherein the at least one sensor includes a first sensor coupled to a first drive sprocket of the pair of drive sprockets and a second sensor coupled to a second drive sprocket of the pair of drive sprockets.

8. An injector head according to claim 1, wherein the first actuator is configured to set a clamping force of the first elongate counter-force member and to adjust a position of the first elongate counter-force member with respect to the injector centerline.

9. An injector head comprising:

a pair of oppositely located, co-operatively movable, segmented, continuous belt drive chains, each belt drive chain of the pair of belt drive chains running over a respective pair of drive sprockets and tension sprockets, each belt drive chain comprising an inner flight and an outer flight, each respective inner flight and outer flight extending between the pair of drive sprockets and the pair of tension sprockets, at least a first portion of the inner flights defining a tubing receiving section for a coiled tubing; and at least one first roller arranged in contact with a second portion of a first of the inner flights and at least one second roller arranged in contact with a second portion of a second of the inner flights;

wherein said at least one first roller is moveable to displace at least said second portion of said first of the inner flights toward the tubing receiving section in order to compensate for any unsynchronized movement of the pair of belt drive chains; and wherein said at least one second roller is moveable to displace at least said second portion of said second of the inner flights away from the tubing receiving section in order to compensate for any unsynchronized movement of the pair of belt drive chains.

10. An injector head according to claim 9, wherein said at least one first roller is coupled to at least one actuator.

11. An injector head according to claim 10, comprising a first set of rollers and a second set of rollers, wherein the first and second set of rollers each comprise at least two rollers, wherein the first set of rollers contacts the inner flight of a first belt chain drive of the pair of belt chain drives and the second set of rollers contacts the inner flight of a second belt chain of the pair of belt chain drives, and wherein the first set of rollers and the second set of rollers are arranged on opposite sides of an injector centerline.

12. An injector head according to claim 9, wherein the injector head comprises at least one sensor for monitoring a position of two oppositely arranged chain blocks, wherein a first chain block of the two oppositely arranged chain blocks is attached to the inner flight of a first of the pair of belt drive chains and a second chain block of the two oppositely arranged chain blocks is attached to the inner flight of a second of the pair of belt drive chains.

13. An injector head according to claim 12 wherein the at least one sensor is a shaft torque sensor arranged to register a torque difference between the pair of drive sprockets.

14. An injector head according to claim 12, wherein the at least one sensor is adapted to continuously monitor the position of the two oppositely arranged chain blocks, each of the two oppositely arranged chain blocks initially being in contact with the coiled tubing while the coiled tubing is being mated to the injector head.

15. An injector head according to claim 14, wherein the at least one sensor includes a first sensor coupled to a first drive sprocket of the pair of drive sprockets and a second sensor coupled to a second drive sprocket of the pair of drive sprockets.

16. An injector head according to claim 12, wherein at least one actuator is in communication with the at least one sensor via a control system.

17. An injector head according to claim 9, wherein a pressure device is adapted to allow movement of each belt drive chain in a longitudinal direction parallel with the tubing receiving section.

18. An injector head comprising:

a pair of oppositely located co-operatively moveable, segmented continuous belt drive chains, each belt drive chain of the pair of belt drive chains running over a respective pair of drive sprockets and tension sprockets, each belt drive chain comprising a plurality of chain blocks adapted to be in contact with a continuous tubing when the continuous tubing is being mated into the injector head; and at least one sensor for measuring a parameter associated with two oppositely arranged chain blocks, the at least one sensor cooperating with a control system configured to adjust a position of one or both of the two oppositely arranged chain blocks when the two oppositely arranged chain blocks are in contact with the continuous tubing in different planes that are transversely arranged relative to a longitudinal axis of the continuous tubing in order to maintain the two oppositely arranged chain blocks in a same plane when in contact with the continuous tubing.

19. An injector head according to claim 18, comprising an actuator in operationally connected with the control system, said actuator being arranged to displace a portion of one of the pair of belt drive chains towards an injector head centerline.

20. An injector head according to claim 19, wherein said actuator is coupled to at least one roller.

21. An injector head according to claim 19, wherein said actuator is coupled to a pair of elongate counter-force members positioned on either side of the injector head centerline and wherein said actuator is adapted to move the pair of elongate counter-force members an equal distance in a same direction transverse to the injector head centerline.

22. An injector head comprising:

a pair of oppositely located co-operatively moveable, segmented, continuous belt drive chains, each belt drive chain of the pair of belt drive chains running over a respective pair of drive sprockets and tension sprockets, each belt drive chain comprising a plurality of chain blocks adapted to be in contact with a continuous tubing when the continuous tubing is passing into the injector head; and a control system configured to adjust a position of one or both of two oppositely arranged chain blocks of the plurality of chain blocks when the two oppositely arranged chain blocks are in contact with the continuous tubing in different planes perpendicular to a longitudinal direction of the continuous tubing in order to maintain the two oppositely arranged chain blocks in a same plane when the two oppositely arranged chain blocks are in contact with the continuous tubing.

23. A method for synchronizing a pair of oppositely located, co-operatively movable, segmented continuous belt drive chains of an injector head, each belt drive chain running over a respective pair of drive sprockets and tension sprockets, each belt drive chain comprising an inner flight and an outer flight, each respective inner flight and outer flight extending between the pair of drive sprockets and the pair of tension sprockets, at least a portion of said respective inner flights defining a tubing receiving section for a continuous tubing, said belt drive chain comprising a plurality of chain blocks continuously arranged on the belt drive chain adapted to be in contact with the continuous tubing when the continuous tubing is being mated into or retrieved out of the injector head, the method comprising:

a) rotating each of the pair of belt drive chains via the pair of drive sprockets so that a portion of the inner flight of the respective belt drive chain engages the continuous tubing;

b) measuring a respective position of two oppositely arranged chain blocks that are in contact with the continuous tubing while said continuous tubing passes through the injector head;

c) checking the respective positions of the two oppositely arranged chain blocks to determine if the two oppositely arranged chain blocks are arranged perpendicular to a longitudinal axis of the continuous tubing; and d) adjusting a portion of one or both of said inner flights by moving an actuator towards the continuous tubing receiving section when respective chain blocks are not arranged in a same plane that is perpendicular to the longitudinal axis of the continuous tubing.

24. The method according to claim 23, wherein steps a) through d) are repeated.

25. The method according to claim 23, wherein an initial contact position of the two oppositely arranged chain blocks is measured by at least one sensor.

* * * * *